US005455974A

United States Patent [19]

Strobel

[11] Patent Number: 5,455,974

[45] Date of Patent: Oct. 10, 1995

[54] CUSHIONED FRAME FOR FULL FLOTATION WATER BED

[76] Inventor: Mark J. Strobel, 3131 Industrial Pkwy., Jeffersonville, Ind. 47130

[21] Appl. No.: 204,587

[22] Filed: Mar. 1, 1994

Related U.S. Application Data

[63] Continuation-in-part of Ser. No. 27,195, Mar. 5, 1993, Pat. No. 5,291,624.

[51] Int. Cl.[6] ..... A47C 27/08; A47C 19/00

[52] U.S. Cl. ..... 5/451; 5/917

[58] Field of Search ..... 5/451, 452, 917, 5/400, 53.1, 663

[56] References Cited

U.S. PATENT DOCUMENTS 4,862,543 9/1989 Falwell et al. ..... 5/663

5,027,453 7/1991 Koening ..... 5/451

5,231,716 8/1993 Johenning et al. ..... 5/451

5,267,362 12/1993 Johenning ..... 5/400

*Primary Examiner*—Alexander Grosz

*Attorney, Agent, or Firm*—James B. Middleton

[57] ABSTRACT

A rail for forming a full flotation water bed has a lower member of wood or the like placed on its edge to achieve height, and a flange fixed to the lower member to provide flexural strength and the desired width for the upper, cushion member. The upper cushion member is fixed to the transition member and provides a soft surface on the rails while contributing to the total height of the rail. The rail is then covered with a sheet material for aesthetic purposes. A bed frame made of the new rails may have long longitudinal rails to provide extensions to receive a headboard. In the extensions, blocks rest on the transition member and extend to the top of the cushion member for supporting the headboard. Transverse rails may be conventional rails, or the new rails of the present invention.

3 Claims, 1 Drawing Sheet

CUSHIONED FRAME FOR FULL FLOTATION WATER BED

CROSS-REFERENCE TO RELATED APPLICATION

This application is a continuation-in-part of the application Ser. No. 08/027,195, by the same inventor titled "Frame for Waterbeds", filed Mar. 5, 1993, which will issue on Mar. 8, 1994, as U.S. Pat. No. 5,291,624.

BACKGROUND OF THE INVENTION

1. Field of the Invention

This invention relates generally to water bed frames, and is more particularly concerned with a cushioned frame for a full flotation water bed.

2. Discussion of the Prior Art

There has long been a desire to provide a full flotation water bed (which has about 9¼ inches, or about 23½ cm, of water) with soft rails that are comfortable for sitting on the edge of the bed. The full flotation and soft rails tend to be mutually exclusive because the pressure of the water exerts such a great force on the rails that soft rails quickly bow outward and fail to contain the water mattress properly.

One effort at providing soft rails comprises the use of rails that are all foam, the inside surface of the rails being sloped, both to distribute the outward force and to have wide foam at the bottom for greater strength. Such rails are only partially successful, and require a special mattress. Water bed dealers prefer to buy various parts of beds from various manufacturers; and, if a particular frame requires one specific mattress, a dealer will typically not stock that frame. Therefore, any successful frame must accept a conventional mattress of the type that may be available from several different manufacturers.

Prior art frames, in an effort to prevent bowing of the side rails, have utilized flanges for strengthening the rails. Though such flanges will in fact strengthen a rail, it has been conventionally believed that the full height of the conventional side rail was still required. As a result, the only prior art solution to the hard, uncomfortable side rails has been the addition of a rail cap, which simply adds a pad to the conventional, usually wooden, side rails.

SUMMARY OF THE INVENTION

The present invention provides a rail for a full flotation water bed wherein the upper portion of the rail comprises cushioning material, and the lower portion comprises wood or other generally rigid material. A first member is placed on its edge to provide height; then, a flange is fixed to the first member both to provide flexural strength and to yield a surface to receive the upper piece. Finally, a piece of cushioning material of approximately the width of the flange, and of sufficient height to complete the water bed depth, is fixed to the flange. The resulting rail may be covered with a vinyl or other sheet material, including fabrics and the like.

As an alternative, the first member can be replaced by other structural members, such as a member formed of struts, studs or other conventional construction.

In the above identified co-pending application, a rail having foam on the top is disclosed; however, the present inventor followed the usual thinking that great strength would be required on the bottom because the top of the rail is only foam. It was discovered, however, that a light weight and inexpensive rail can be used in the combination disclosed herein. One embodiment utilizes the single piece of wood, and another embodiment utilizes a strut or the like.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
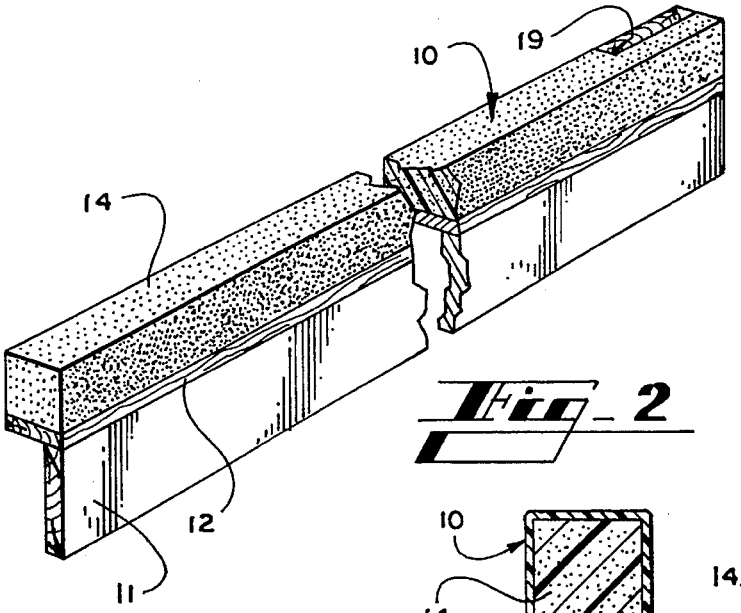
FIG. 1 is a perspective view showing one rail made in accordance with the present invention.

Referring now more particularly to the drawings, and to those embodiments of the invention here presented by way of illustration, FIG. 1 shows a rail generally designated at 10 including a lower, first member 11, an intermediate, or transition member 12, and an upper, cushion member 14.

Figure 2:
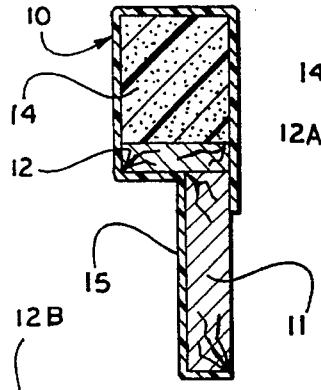
FIG. 2 is a transverse cross-sectional view through the rail shown in FIG. 1.

With attention to both FIGS. 1 and 2, it will be seen that the lower member 11 is shown as formed of a single piece of wood. Those skilled in the art will realize that the conventional waterbed frame is made of standard, dressed 2×10 lumber, giving a height of 9¼" (23.5 cm.). Such a frame is very economical, and it is difficult to manufacture a frame of more sophisticated materials and sell at a competitive price. Thus, the frame of the present invention utilizes the same type of material, but may use wafer board or other inexpensive materials; and, the size is smaller. By way of example, one successful embodiment of the invention uses a lower piece that is 5¼" (13.3 cm) by 1⅛" (2.9 cm).

The transition piece 12 is fixed to the lower piece 11 by nails, screws, glue or the like. The transition piece 12 has a width greater than the lower piece 11 both to provide lateral flexural strength to the rail 10 and to support the upper cushion member 14. Again, the transition piece 12 may be natural lumber, wafer board or other materials. It is anticipated that the transition piece will measure ¾" by 3" (1.9 by 7.6 cm).

The upper piece is formed of cushion material, preferably a foam such as expanded polyurethane. The upper piece 14 is fixed to the transition piece 13 by glue or the like, and is tall enough to complete the height of the conventional rail. It will therefore be understood that the upper piece is 3" (7.6 cm) wide to match the transition piece, and 3½" (8.9 cm) high to provide the needed height. Those skilled in the art will understand that the dimensions of the rail described may vary to suit individual tastes. The upper piece 14 may have a height from 1" (2.5 cm) to 6" (15.2 cm), though the width should be increased to maintain lateral stability. Also, when the upper piece 14 is changed in height, the other pieces 11 and/or 12 must be changed in order to maintain the desired depth.

As shown in the drawings, the rail 10 is covered with a sheet material 15 to improve the appearance of the rail. It will be realized that the wood portions of the rail may be painted or the like, and the fabric extended over only the cushion 14. As here shown, however, the sheet material 15 extends completely over the exposed part of the rail, and extends down on the inside of the rail sufficiently to enclose the cushion member 14. The sheet material 15 may be a vinyl sheet, woven or non-woven fabric or the like. The sheet material 15 can easily be stapled to the rail 10, or it may be glued or otherwise bonded to the rail.

Figure 3:
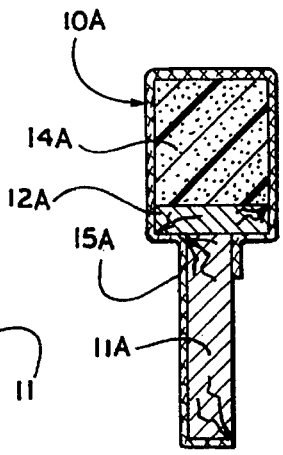
FIG. 3 is a view similar to FIG. 2 but showing a modified form thereof.

FIG. 3 of the drawings shows a slightly modified form of rail designated at 10A. The rail 10A includes the lower piece 11A, the transition piece 12A and the upper piece 14A. The difference in construction is that the transition piece 12A is centered on the lower piece 11A instead of extending to one side as in FIG. 2. It will be understood that the strength will be the same, but the appearance will be somewhat different. Also, FIG. 3 is shown as covered with a fabric 15A, whereas FIG. 2 is shown as covered with a plastic sheet material 15.

Figure 4:
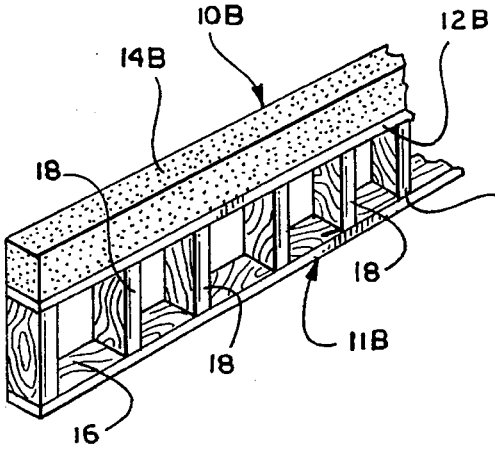
FIG. 4 is perspective view on a reduced scale showing a modified form of rail made in accordance with the present invention; and, FIG. 5 is a top plan view of four rails made in accordance with the present invention in place on a bed, ready to receive a mattress.

Attention is next directed to FIG. 4 of the drawings where a different embodiment of the invention is shown. In this embodiment, the rail is designated at 10B, and the lower piece 11B is a fabricated member having a bottom plate 16 and a plurality of studs 18. The transition piece 12B acts as both the transition piece and as the top plate for the lower piece 11B. The cushion member 14B is then fixed to the piece 12B. While this embodiment of the invention will require more fabrication, hence more labor, the open work of the lower piece 11B reduces the amount of material and reduces the cost of a fabricated rail.

It should also be understood that the showing of the plates and studs in FIG. 4 is only by way of example, and those skilled in the art will devise other open-work constructions that will serve equally well as the lower piece 11B.

Figure 5:
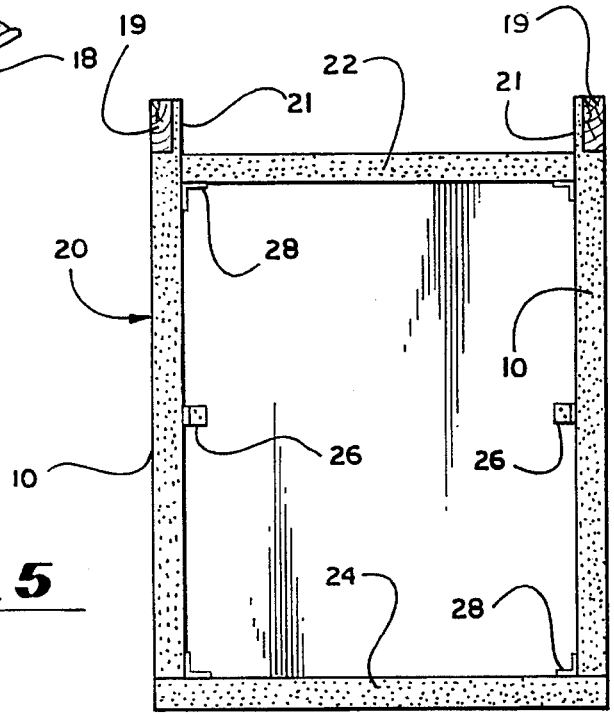

Looking at FIGS. 1 and 5 of the drawings, it should now be observed that the rail 10 in FIG. 1 includes a block 19 in the upper member 14. This block 19 extends down to rest on the transition piece 12. The purpose of the block 19 can be understood from FIG. 5, where two rails 10 are shown making up a bed frame 20. The two rails 10 are longer than the bed 20, providing extensions 21 for supporting a headboard (not shown). It will be readily understood that the cushion material of the upper piece 14 would not give adequate support to a head board; thus, the blocks 19 are provided to support the headboard.

Continuing to look at FIG. 5, the transverse rails 22 and 24 may be rails made in accordance with the present invention, or may be conventional rails. In either case, the rails are placed on a deck 25 and fixed to the deck 25 by angle brackets 26. To hold the rails together, there are further angle brackets 28 in the four corners.

From the foregoing discussion, it will be understood that the present invention provides a rail for a full flotation water bed, the rail having a cushioned upper section and a rigid lower section. The rigid lower section, in combination with the transition piece yields adequate strength to prevent the rails from bowing, especially when fixed to the deck as is conventional. While the present invention allows the rails to be covered in fabric or the like, the fabric is not relied on to hold the rails together, or to hold the rails to the deck or prevent bowing, as in conventional soft sided beds.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A bed frame for receiving a full flotation water mattress, said bed frame comprising two longitudinal rails, each of said longitudinal rails comprising a rigid lower member, a rigid transition member fixed to said lower member and parallel thereto, and a cushion member fixed to said transition member and parallel thereto, the sum of the heights of said lower member, said transition member and said cushion member being equal to the rail height of a conventional rail for a full flotation water bed, said longitudinal rails extending beyond said bed frame for defining extensions for receiving a headboard, said extensions including a pair of blocks extending from said transition member to the upper surface of said cushion member for supporting a headboard.

2. A bed frame as claimed in claim 1, said longitudinal rails further including a sheet material covering said lower member, said transition member and said cushion member.

3. A bed frame as claimed in claim 2, wherein said cushion member has a height in the range of 1 inch to 6 inches.

* * * * *